US006464553B2

(12) United States Patent
Huang

(10) Patent No.: US 6,464,553 B2
(45) Date of Patent: Oct. 15, 2002

(54) GEOMETRIC CONSTRUCTION SYSTEM

(76) Inventor: Te-Li Huang, No. 17, Alley 2, Lane 260, Han-Hsi W. Rd., Tung Dist., Taichung City (TW)

( * ) Notice: Subject to any disclaimer, the term of this patent is extended or adjusted under 35 U.S.C. 154(b) by 28 days.

(21) Appl. No.: 09/836,137

(22) Filed: Apr. 17, 2001

(65) Prior Publication Data

US 2002/0065018 A1 May 30, 2002

Related U.S. Application Data

(63) Continuation-in-part of application No. 09/725,781, filed on Nov. 29, 2000.

(51) Int. Cl.[7] ..... A63H 33/10
(52) U.S. Cl. ..... 446/104; 446/109; 446/111
(58) Field of Search ..... 446/104, 108, 446/109, 110, 111, 112, 116, 118

(56) References Cited

U.S. PATENT DOCUMENTS 4,270,302 A * 6/1981 Dandia
5,100,358 A * 3/1992 Volgger ..... 446/104
5,137,485 A * 8/1992 Penner ..... 446/111
5,472,365 A * 12/1995 Engel ..... 446/104
6,176,757 B1 * 1/2001 Lin ..... 446/111 X
6,186,855 B1 * 2/2001 Bauer et al. ..... 446/104

* cited by examiner

*Primary Examiner*—John A. Ricci
(74) *Attorney, Agent, or Firm*—Ladas & Parry

(57) ABSTRACT

A geometric construction system includes at least two substantially flat panels and at least a connecting rod. Each panel has a frame piece and a pair of cover sheets. The frame piece has side walls with side edges, each of which has a basin section, and further has an inner face defining a central opening. The inner face is formed with a flange that cooperates with the inner face to define a pair of retaining grooves. The connecting rod has at least two interconnected connecting portions, each of which is complementary to and is received in the basin section. The cover sheets are respectively and fittingly received in the retaining grooves.

2 Claims, 6 Drawing Sheets

GEOMETRIC CONSTRUCTION SYSTEM

CROSS-REFERENCE TO RELATED APPLICATION

This application is a continuation-in-part (CIP) of co-pending U.S. patent application Ser. No. 09/725,781, filed by the applicant on Nov. 29, 2000, and is further related to co-pending U.S. patent application Ser. No. 09/767,102, filed by the applicant on Jan. 22, 2001, the entire disclosures of which are incorporated herein by reference.

BACKGROUND OF THE INVENTION

1. Field of the Invention

This invention relates to a geometric construction system, more particularly to a geometric construction system including a plurality of flat panels and a plurality of connecting rods for sidewisely interconnecting the panels.

2. Description of the Related Art

As described in the specification of the aforementioned co-pending U.S. patent application Ser. No. 09/725,781, conventional geometric construction systems are disadvantageous in that the flat panels of the same cannot overlap with each other.

It has since been found that, because each flat panel described in the specification of the co-pending U.S. patent application Ser. No. 09/725,781 is an integral relative thick piece, a large amount of raw material is required for the production of the flat panels, and the geometric construction system, which is constructed by the flat panels, will be relative heavy.

SUMMARY OF THE INVENTION

Therefore, it is an object of the present invention to provide a geometric construction system that is capable of permitting two adjacent coupled panels to overlap with each other and that is capable of lowering the production cost and reducing the weight of the geometric construction system.

Accordingly, a geometric construction system of this invention comprises: at least two substantially flat panels of equilateral polygonal shape, each of the panels having a frame piece and a pair of cover sheets, the frame piece having an inner face that defines a central opening in the frame piece, and a plurality of side walls with side edges, each of which has two opposite end sections and a basin section that extends between and inwardly relative to the end sections and that has two opposite end faces respectively transverse to the end sections, the inner face being formed with a central flange that extends along the inner face, that projects inwardly into the central opening, and that cooperates with the inner face to define a pair of opposite retaining grooves at two opposite sides of the flange, each of the cover sheets having side edges respectively and fittingly received in a respective one of the retaining grooves so that the pair of the cover sheets are spaced apart at least by a thickness of the flange; and at least a connecting rod having at least two interconnected connecting portions, each of which extends in a longitudinal direction and each of which is complementary to and is received in the basin section of one of the side edges of the side walls of the frame piece of one of the flat panels, each of the connecting portions having two opposite ends respectively pivoted on the end faces of the basin section of said one of the side edges of the side walls of the frame piece of the respective one of the flat panels so as to permit each of the panels to be freely turnable about an axis that extends through the opposite ends of the respective one of the connecting portions of the connecting rod in the longitudinal direction.

BRIEF DESCRIPTION OF THE DRAWINGS

In drawings which illustrate an embodiment of the invention.

DETAILED DESCRIPTION OF THE PREFERRED EMBODIMENT

Figure 1:
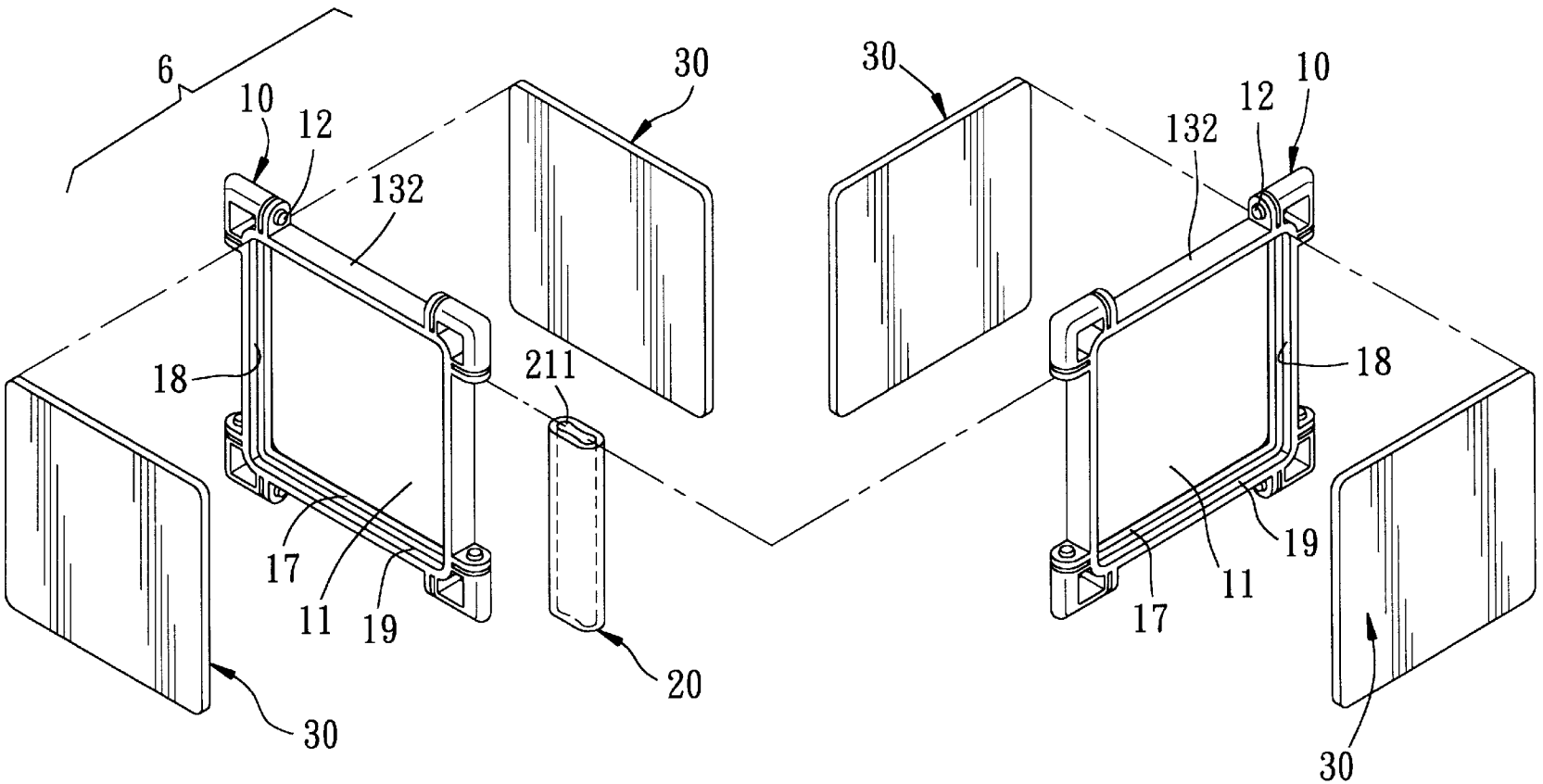
FIG. 1 is an exploded view of a geometric construction system embodying this invention, with two square panels to be coupled by a connecting rod having a generally elliptical cross-section.
Figure 2:
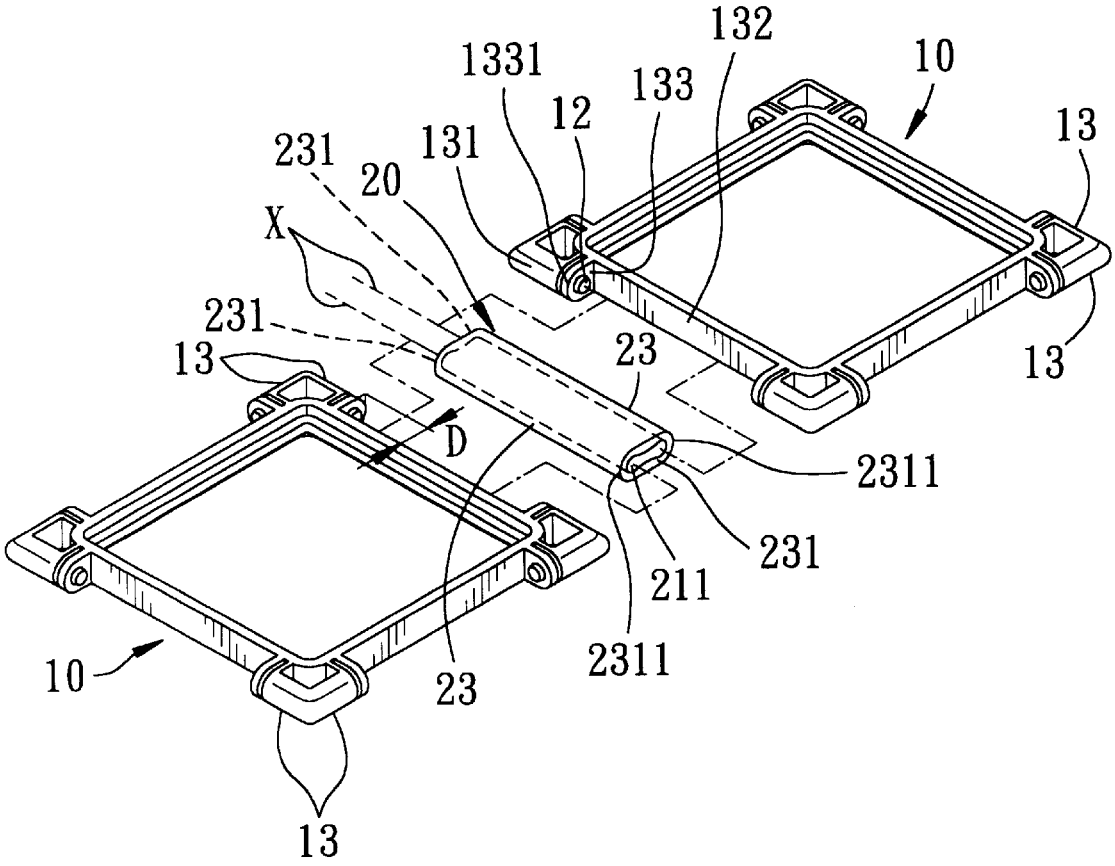
FIG. 2 is a fragmentary exploded view of the geometric construction system of FIG. 1 viewed from top side.
Figure 3:
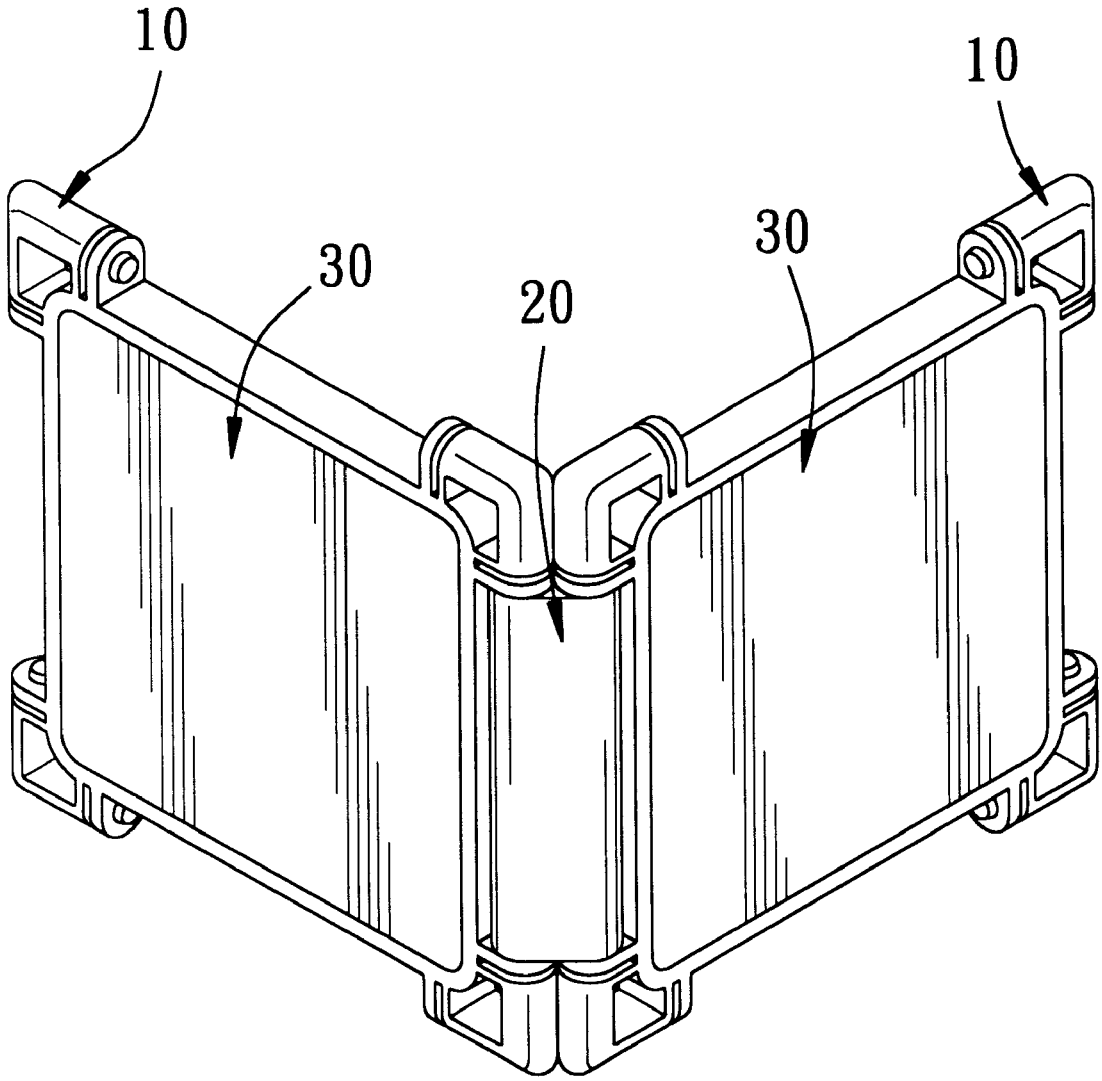
FIG. 3 is a perspective view to illustrate the panels being coupled by the connecting rod of the geometric construction system of FIG. 1.
Figure 4:
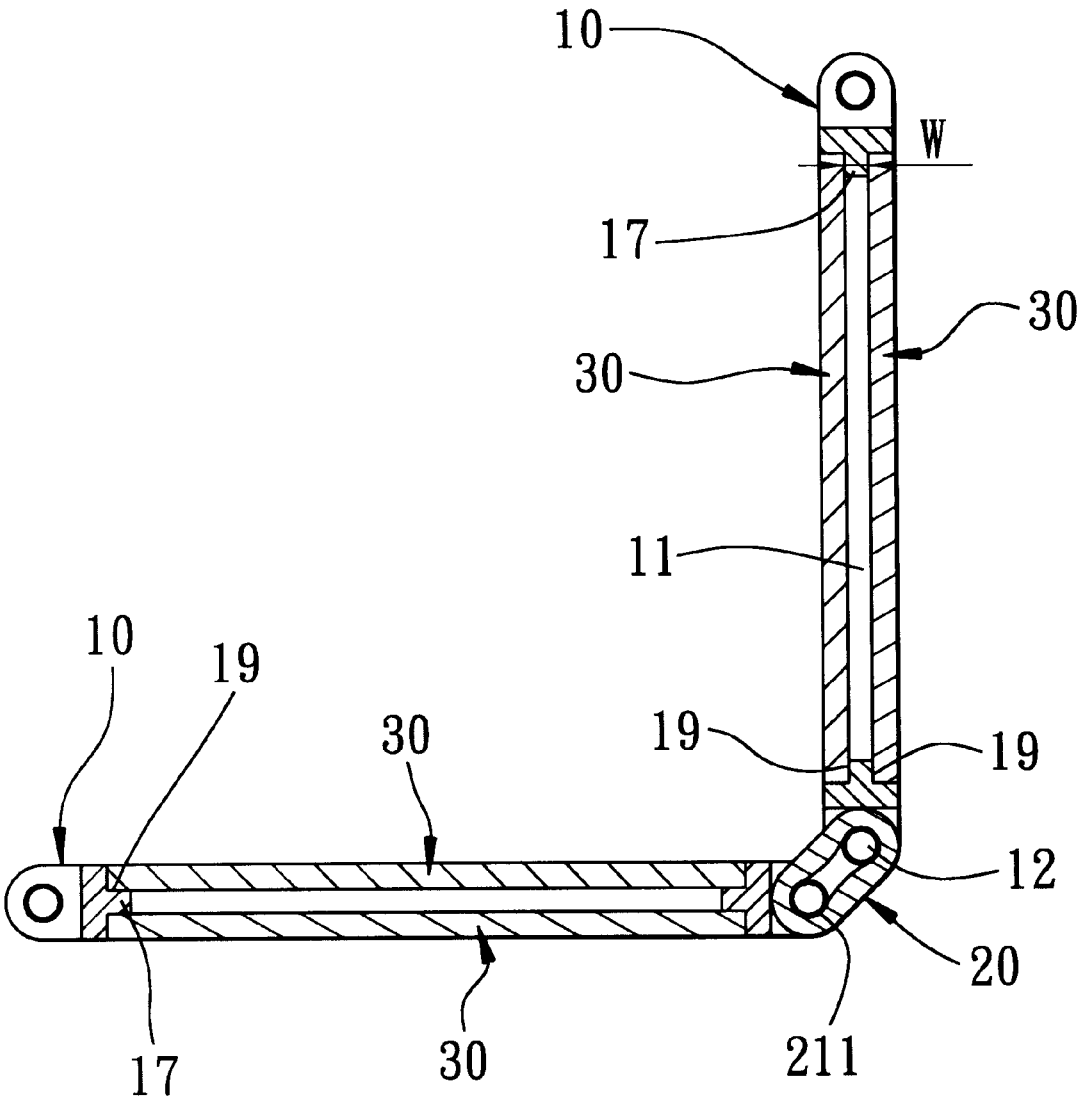
FIG. 4 is a cross-sectional top view of the coupled panels of FIG. 3.

FIGS. 1 to 4 illustrate a preferred embodiment of a geometric construction system of this invention. The geometric construction system includes: at least two substantially flat panels 6 of equilateral polygonal shape, each of the panels 6 having a frame piece 10 and a pair of cover sheets 30, the frame piece 10 having an inner face 18 that defines a central opening 11 in the frame piece 10, and a plurality of side walls 13 with side edges, each of which has two opposite end sections 131 and a basin section 132 that extends between and inwardly relative to the end sections 131 and that has two opposite end faces 133 respectively transverse to the end sections 131, the inner face 18 being formed with a central flange 17 that extends along the inner face 18, that projects inwardly into the central opening 11, and that cooperates with the inner face 18 to define a pair of opposite retaining grooves 19 at two opposite sides of the flange 17, each of the cover sheets 30 having side edges respectively and fittingly received in a respective one of the retaining grooves 19 so that the pair of the cover sheets 30 are spaced apart at least by a thickness (W) of the flange 17; and at least a connecting rod 20 of a generally elliptical cross-section, which has two interconnected connecting portions 23, each of which extends in a longitudinal direction and each of which is complementary to and is received in the basin section 132 of one of the side edges of the side walls of the frame piece 10 of a respective one of the flat panels 6. Each of the connecting portions 23 has two opposite ends 231 respectively pivoted on the end faces 133 of the basin section 132 of one of the side edges of the side walls 13 of the frame piece 10 of the respective one of the flat panels 6 so as to permit each of the panels 6 to be freely turnable about an axis (X) that is defined by the respective connecting portion 23 and that extends through the opposite ends 231 of the respective one of the connecting portions 23 of the connecting rod 20 in the longitudinal direction. Each of the polygonal panels 6 is square in shape for this embodiment.

Each of the end faces 133 of the basin section 132 of each of the side edges of the side walls 13 of the frame piece 10 of each flat panel 6 is formed with a boss 12 projecting therefrom and transverse thereto. Each of the ends 231 of each of the connecting portions 23 of the connecting rod 20 is formed with a recess 211 that fittingly receives the boss 12 on the respective one of the end faces 133 so as to permit rotation of each of the panels 6 about the respective axis (X). It is apparent to a person skilled in the art that each of the end faces 133 of the basin section 132 can be formed with the recess 211 instead of the boss 12, and that each of the ends 231 of each of the connecting portions 23 can be formed with the boss 12 instead of the recess 211. Alternatively, one of the end faces 133 of the basin section 132 can be formed with the boss 12 and the other one can be formed with the recess 211, whereas one of the ends 231 of each of the connecting portions 23 can be formed with the boss 12 and the other one can be formed with the recess 211.

Each of the end faces 133 has a rounded edge 1331 circumferentially surrounding the boss 12. The basin section 132 of each of the side edges has a depth (D) greater than the diameter of the associated rounded edge 1331. Each of the ends 231 of each of the connecting portions 23 has a rounded edge 2311 circumferentially surrounding the recess 211, and further has a diameter that is substantially equal to that of the rounded edge 1331 of the associated end face 133. The axis (X) passes through centers of the rounded edges 1331 of the end faces 133 of the basin section 132 and the rounded edges 2311 of the ends 231 of the respective one of the connecting portions 23. Preferably, the connecting rod 20 has a width substantially equal to two times of the diameter of the rounded edge 1331 of each of the end faces 133 so as to permit two coupled panels 6 to be able to overlap evenly with each other (see FIG. 5).

Figure 5:
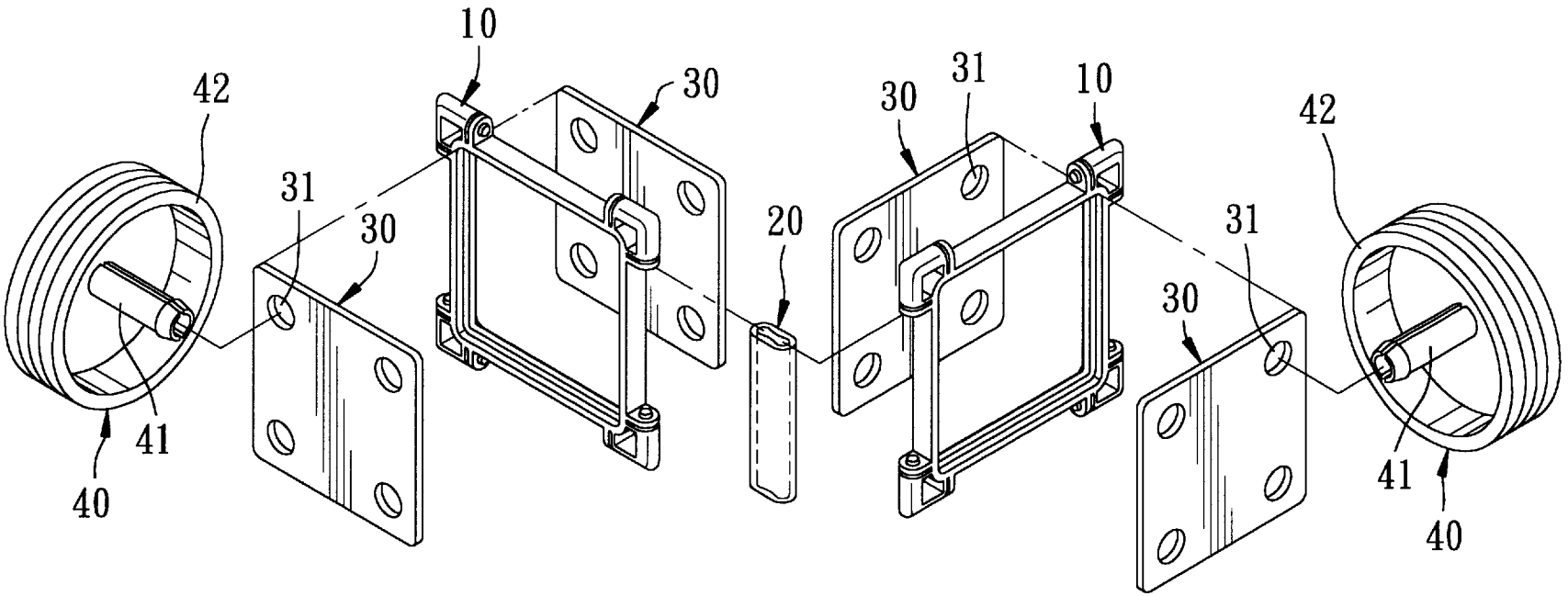
FIGS. 5 and 6 illustrate wheel members coupled to the panels of the geometric construction system of FIG. 1.
Figure 6:
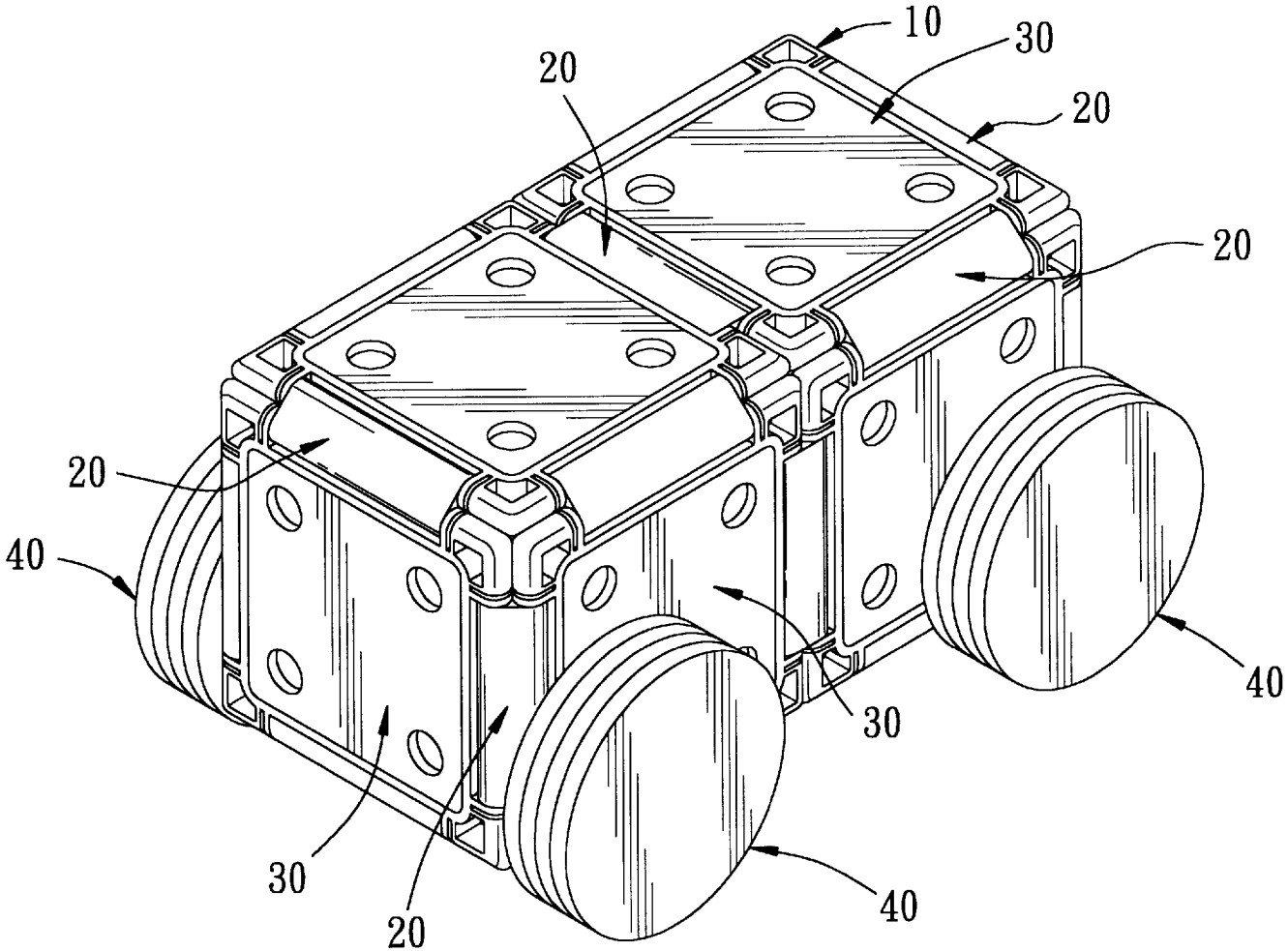

Referring to FIGS. 5 and 6, in combination with FIG. 1, each of the cover sheets 30 can be formed with four through-holes 31 respectively at four corners thereof, and the geometric construction system of this invention can further include wheel members 40, each of which includes a wheel piece 42 and a shaft 41 that extends from a center of the wheel piece 42 and that extends rotatably through one of the through-holes 31 in one of the cover sheets 30 so as to increase attractiveness and amusement when playing with the geometric construction system of this invention.

With the connecting rod 20 being formed with a plurality of spaced apart recesses 2311 in each end 231 of each connecting portion 23, and with the end faces 133 of the basin section 132 of each side edge 13 being formed with the bosses 12, each one of two coupled panels 6 is permitted to be freely rotated about the respective axis (X) toward and away from an adjacent panel 6, and the coupled panels 6 are permitted to be evenly stacked one above the other.

With the invention thus explained, it is apparent that various modifications and variations can be made without departing from the spirit of the present invention. It is therefore intended that the invention be limited only as recited in the appended claims.

I claim:

1. A geometric construction system comprising:

at least two substantially flat panels of equilateral polygonal shape, each of said panels having a frame piece and a pair of cover sheets, said frame piece having an inner face that defines a central opening in said frame piece, and a plurality of side walls with side edges, each of which has two opposite end sections and a basin section that extends between and inwardly relative to said end sections and that has two opposite end faces respectively transverse to said end sections, said inner face being formed with a central flange that extends along said inner face, that projects inwardly into said central opening, and that cooperates with said inner face to define a pair of opposite retaining grooves at two opposite sides of said flange, each of said cover sheets having side edges respectively and fittingly received in a respective one of said retaining grooves so that said pair of said cover sheets are spaced apart at least by a thickness of said flange; and at least a connecting rod having at least two interconnected connecting portions, each of which extends in a longitudinal direction and each of which is complementary to and is received in said basin section of one of said side edges of said side walls of said frame piece of one of said flat panels, each of said connecting portions having two opposite ends respectively pivoted on said end faces of said basin section of said one of said side edges of said side walls of said frame piece of the respective one of said flat panels so as to permit each of said panels to be freely turnable about an axis that extends through said opposite ends of the respective one of said connecting portions of said connecting rod in the longitudinal direction.

2. The geometric construction system of claim 1, wherein each of said cover sheets is formed with through-holes, said geometric construction system further comprising a wheel member that includes a wheel piece and a shaft that extends from a center of said wheel piece and that extends rotatably through one of said through-hole in one of said cover sheets.

* * * * *